US006686001B2

(12) United States Patent
Gallo et al.

(10) Patent No.: US 6,686,001 B2
(45) Date of Patent: Feb. 3, 2004

(54) INK JET PRINTING METHOD

(75) Inventors: Elizabeth A. Gallo, Penfield, NY (US); Sridhar Sadasivan, Rochester, NY (US); Xiaoru Wang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 85 days.

(21) Appl. No.: 10/017,423

(22) Filed: Dec. 12, 2001

(65) Prior Publication Data

US 2003/0107636 A1 Jun. 12, 2003

(51) Int. Cl.[7] ..... B41M 5/00; B41J 2/01

(52) U.S. Cl. ..... 428/32.36; 428/32.31; 428/32.29; 428/32.37; 428/32.38; 347/105

(58) Field of Search ..... 428/195, 32.31, 428/32.29, 32.36, 32.37, 32.38; 347/105

(56) References Cited

U.S. PATENT DOCUMENTS 5,912,071 A 6/1999 Takeshita et al.
6,099,956 A 8/2000 Jones

*Primary Examiner*—Pamela R. Schwartz
(74) *Attorney, Agent, or Firm*—Harold E. Cole; Chris P. Konkol

(57) ABSTRACT

An ink jet printing method having the steps of: A) providing an ink jet printer that is responsive to digital data signals; B) loading the printer with ink jet recording element having a substrate having thereon a porous image-receiving layer of a) organic particles encapsulated with an organic polymer having a Tg of less than about 100 ° C.; and b) water-insoluble, cationic, polymeric particles; C) loading the printer with an ink jet ink composition; and D) printing on the image-receiving layer using the inkjet ink composition in response to the digital data signals.

20 Claims, No Drawings

INK JET PRINTING METHOD

CROSS REFERENCE TO RELATED APPLICATION

Reference is made to commonly assigned, co-pending U.S. patent application Ser. No. 10/020443 by Sadasivan et al., filed of even date herewith entitled "Ink Jet Recording Element".

FIELD OF THE INVENTION

This invention relates to an ink jet printing method using an ink jet recording element. More particularly, this invention relates to an ink jet printing method using an ink jet recording element containing a multiplicity of particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. A major challenge in the design of a porous image-recording layer is to be able to obtain good quality, crack-free coatings with as little non-particulate matter as possible. If too much non-particulate matter is present, the image-recording layer will not be porous and will exhibit poor ink dry times.

U.S. Pat. No. 5,912,071 relates to a recording medium comprising a substrate and a porous layer formed on the substrate wherein the porous layer comprises water-insoluble resin particles preferably having a core/shell structure. However, there is no disclosure in this reference of the use of a combination of water-insoluble, cationic, polymeric particles and particles having a core/shell structure. An element with an image-receiving layer that does not contain water-insoluble, cationic resin particles would not have good image quality. An element with an image-receiving layer that does not contain particles having a core/shell structure would exhibit cracking.

U.S. Pat. No. 6,099,956 relates to a recording medium comprising a support with a receptive layer coated thereon. The receptive layer comprises a water insoluble polymer, which is preferably, a copolymer comprising a styrene core with an acrylic ester shell. However, there is no disclosure in this reference of the use of a combination of water-insoluble, cationic, polymeric particles and particles having a core/shell structure. An element with an image-receiving layer that does not contain water-insoluble, cationic resin particles would not have good image quality. An element with an image-receiving layer that does not contain particles having a core/shell structure would exhibit cracking.

It is an object of this invention to provide an ink jet printing method employing a porous ink jet recording element that has instant dry time when used in ink jet printing. It is another object of this invention to provide an ink jet printing method employing a porous recording element that has good coating quality, especially reduced cracking. It is another object of this invention to provide an ink jet printing method employing an ink jet recording element that exhibits good image quality after printing.

SUMMARY OF THE INVENTION

These and other objects are achieved in accordance with the invention, which comprises an ink jet printing method comprising the steps of:

A) providing an ink jet printer that is responsive to digital data signals;

B) loading the printer with ink jet recording element comprising a substrate having thereon a porous image-receiving layer comprising
   a) organic particles encapsulated with an organic polymer having a Tg of less than about 100° C.; and
   b) water-insoluble, cationic, polymeric particles;

C) loading the printer with an ink jet ink composition; and

D) printing on the image-receiving layer using the ink jet ink composition in response to the digital data signals.

By use of the invention, an ink jet recording element is obtained that has good coating and image quality when used in ink jet printing.

DETAILED DESCRIPTION OF THE INVENTION

Any organic particle may be used to prepare the encapsulated particles employed in the invention. In a preferred embodiment, the organic particles are polymeric particles, such as particles made from poly(methylmethacrylate), poly (styrene), poly(p-methylstyrene), poly(t-butylacrylamide), poly(styrene-co-methylmethacrylate), poly(styrene-co-t-butylacrylamide), poly(methylmethacrylate-co-t-butylacrylamide), and homopolymers derived from p-cyanophenyl methacrylate, pentachlorophenyl acrylate, methacrylonitrile, isobornyl methacrylate, phenyl methacrylate, acrylonitrile, isobornyl acrylate, p-cyanophenyl acrylate, 2-chloroethyl acrylate, 2-chloroethyl methacrylate, 2-naphthyl acrylate, n-isopropyl acrylamide, 1-fluoromethyl methacrylate, isopropyl methacrylate, and 2-hydroxypropyl methacrylate. In a preferred embodiment of the invention, the core polymer is derived from a styrene-containing monomer or an acrylate-containing monomer, such as poly(methylmethacrylate), poly(styrene), poly(p-methylstyrene), poly(t-butylacrylamide) or poly(styrene-co-methylmethacrylate). In another preferred embodiment of the invention, the particle size of the inorganic particles is from about 5 nm to about 1000 nm. In yet another preferred embodiment of the invention, the Tg of the organic particle is at least about 60° C., preferably from about 60° C. to about 150° C.

The encapsulated particles used in the invention may be prepared in a preferred embodiment by polymerizing one or more monomers in the presence of the organic particles. Useful polymerization techniques can be found in "Emulsion Polymerization and Emulsion Polymers", edited by P. A. Lovell and M. S. El-Aassar, John Wiley and Sons, 1997. Another embodiment relates to preparing the encapsulated particles by adsorbing polymer onto the surface of the organic particles. Another embodiment relates to preparing the encapsulated particles by forming chemical bonds between the organic particles and the polymer either before or after it is formed from the monomer.

The organic polymer used for encapsulation of the organic particles employed in the invention has a Tg of less than about 100° C., preferably from about −50° C. to about 65° C. Methods for determining Tg values of organic polymers are described in "Introduction to Physical Polymer Science", 2nd Edition by L. H. Sperling, published by John Wiley & Sons, Inc., 1992. For each of the organic polymers in Table 1 below, the Tg value was calculated as the weighted sum of the Tg values for homopolymers derived from each of the individual monomers, i, that make up the polymer:

$$Tg = \sum_i W_i X_i$$

where W is the weight percent of monomer i in the organic polymer, and X is the Tg value for the homopolymer derived from monomer i. Tg values for the homopolymers were taken from "Polymer Handbook", 2nd Edition by J. Brandrup and E. H. Immergut, Editors, published by John Wiley & Sons, Inc., 1975.

In a preferred embodiment of the invention, monomers used to prepare the organic polymers of the encapsulated particles include acrylate and styrene monomers that may have a cationic, anionic, or nonionic functionality such as quaternary ammonium, pyridinium, imidazolium, sulfonate, carboxylate or phosphonate groups. Examples of useful monomers include: n-butyl acrylate, n-ethylacrylate, 2-ethylhexylacrylate, methoxyethylacrylate, methoxyethoxy-ethylacrylate, ethoxyethylacrylate, ethoxyethoxyethylacrylate, 2-ethylhexyl-methacrylate, n-propylacrylate, hydroxyethylacrylate, etc. and cationic monomers such as a salt of trimethylammoniumethyl acrylate and trimethylammoniumethyl methacrylate, a salt of triethylammoniumethyl acrylate and triethylammoniumethyl methacrylate, a salt of dimethylbenzylammoniumethyl acrylate and dimethylbenzylammoniumethyl methacrylate, a salt of dimethylbutylammoniumethyl acrylate and dimethylbutylammoniumethyl methacrylate, a salt of dimethylhexylammoniumethyl acrylate and dimethylhexylammoniumethyl methacrylate, a salt of dimethyloctylammoniumethyl acrylate and dimethyloctylammoniumethyl methacrylate, a salt of dimethyldodeceylammoniumethyl acrylate and dimethyldocecylammoniumethyl methacrylate, a salt of dimethyloctadecylammoniumethyl acrylate and dimethyloctadecylammoniumethyl methacrylate, etc. Salts of these cationic monomers that can be used include chloride, bromide, methylsulfate, triflate, etc.

Examples of the organic polymers which can be used in the invention to prepare the encapsulated particles include poly(n-butylacrylate-co-vinylbenzyltrimethylammonium chloride), poly(n-butylacrylate-co-vinylbenzyltrimethylammonium bromide), poly(n-butylacrylate-co-vinylbenzyldimethylbenzylammonium chloride) and poly(n-butylacrylate-co-vinylbenzyldimethyloctadecylammonium chloride). In a preferred embodiment of the invention, the polymer can be poly(n-butyl acrylate), poly(2-ethylhexyl acrylate), poly (methoxyethylacrylate), poly(ethoxyethylacrylate), poly(n-butylacrylate-co-trimethylammoniumethyl acrylate methylsulfate), poly(n-butylacrylate-co-trimethylammoniumethyl methacrylate methylsulfate) or poly(n-butylacrylate-co-vinylbenzyltrimethylammonium chloride).

Any weight ratio of organic particle to organic polymer in the encapsulated particles may be used. In a preferred embodiment, the weight ratio is 0.2:1 to 20:1. In another preferred embodiment, the weight ratio is 0.5:1 to 10:1.

Following are examples of organic particles encapsulated with an organic polymer which can be used in the invention:

TABLE 1

| Encapsulated Particle | Organic Particle, A | Organic Polymer, B | Tg of B(° C.) | Ratio of A/B |
|---|---|---|---|---|
| 1 | Poly (styrene) | Poly(n-butyl methacrylate-co-ethyl methacrylate) (1:1) | 40 | 1:1 |
| 2 | Poly (styrene) | Poly(ethyl methacrylate) | 60 | 1:1 |
| 3 | Poly (styrene) | Poly(ethyl methacrylate-co-methyl methacrylate) (1:1) | 82 | 1:1 |
| 4 | Poly (styrene) | Poly(n-butylacrylate-co-trimethylammoniumethyl methacrylate methylsulfate) (1:1) | 12 | 1:1 |
| 5 | Poly (methyl meth-acrylate) | Poly(n-butylacrylate-co-trimethylammoniumethyl methacrylate methylsulfate) (2:1) | 1 | 10:1 |
| 6 | Poly (methyl meth-acrylate) | Poly(ethyl methacrylate-co-trimethylammoniumethyl methacrylate methylsulfate) (2:1) | 58 | 0.5:1 |

In a preferred embodiment of the invention, additional particles may be added to the image-receiving layer such as inorganic particles, e.g., metal oxides or hydroxides, such as alumina, boehmite, hydrated aluminum oxide, titanium oxide or zirconium oxide; clay; calcium carbonate; calcined clay; inorganic silicates; or barium sulfate. Organic particles such as polymeric beads may also be used. Examples of organic particles useful in the invention are disclosed and claimed in U.S. patent application Ser. No.: 09/458,401, filed Dec. 10, 1999, now U.S. Pat. No. 6,364,477; Ser. No. 09/608,969, filed Jun. 30, 2000, now U.S. Pat No. 6,492,006; Ser. No. 09/607,417, filed June 30, 2000, now U.S. Pat. No. 6,390,280; Ser. No. 09/608,466 filed Jun. 30, 2000, now U.S. Pat. No. 6,475,602; Ser. No. 09/607,419, filed Jun. 30, 2000, now U.S. Pat. No. 6,376,599; and Ser. No. 09/822,731, filed Mar. 30, 2001, now U.S. Pat. No. 6,541,103; the disclosures of which are hereby incorporated by reference. In still yet another preferred embodiment, the mean particle size of these additional particles is up to about 5 $\mu$m.

The water insoluble, cationic, polymeric particles useful in the invention can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyper-branched, grafted, random, blocked, or can have other polymer microstructures well known to those in the art. They also can be partially crosslinked. Examples of core/shell particles useful in the invention are disclosed and claimed in U.S. patent application Ser. No. 09/772,097, of Lawrence et al., Ink Jet Printing Method, filed Jan. 26, 2001, now U.S. Pat. No. 6,619,797, the disclosure of which is hereby incorporated by reference. Examples of water dispersible particles useful in the invention are disclosed and claimed in U.S. patent application Ser. No. 09/770,128, of Lawrence et al., Ink Jet Printing Method, filed Jan. 26, 2001, now U.S. Pat. No. 6,454,404; and U.S. patent application Ser. No. 09/770,127, of Lawrence et al., Ink Jet Printing Method, filed Jan. 26, 2001, now U.S. Pat. No. 6,503,608; the disclosures of which are hereby incorporated by reference. In a preferred embodiment, the water insoluble, cationic, polymeric particles comprise at least about 20 mole percent of a cationic mordant moiety.

In another preferred embodiment of the invention, the water insoluble, cationic, polymeric particles which may be used in the invention are in the form of a latex which contains a polymer having a quaternary ammonium salt moiety. In yet another preferred embodiment, the water-insoluble, cationic, polymeric particles comprises a mixture of latexes containing a polymer having a (vinylbenzyl) trimethyl quaternary ammonium salt moiety and a polymer having a (vinylbenzyl)dimethylbenzyl quaternary ammonium salt moiety.

The water insoluble, cationic, polymeric particles useful in the invention can be derived from nonionic, anionic, or cationic monomers. In a preferred embodiment, combinations of nonionic and cationic monomers are employed. In general, the amount of cationic monomer employed in the combination is at least about 20 mole percent.

The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters, vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitriles, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

The water insoluble, cationic, polymeric particles employed in this invention can be prepared using conventional polymerization techniques including, but not limited to bulk, solution, emulsion, or suspension polymerization. In a preferred embodiment of the invention, the water insoluble, cationic, polymeric particles employed have a mean particle size of from about 10 to about 500 nm.

Examples of water insoluble, cationic, polymeric particles which may be used in the invention include those described in U.S. Pat. No. 3,958,995, the disclosure of which is hereby incorporated by reference. Specific examples of these polymers include:

Polymer A. Copolymer of (vinylbenzyl) trimethylammonium chloride and divinylbenzene (87:13 molar ratio)

Polymer B. Terpolymer of styrene, (vinylbenzyl) dimethylbenzylamine and divinylbenzene (49.5:49.5:1.0 molar ratio)

Polymer C. Terpolymer of butyl acrylate, 2-aminoethylmethacrylate hydrochloride and hydroxyethylmethacrylate (50:20:30 molar ratio)

Polymer D. Copolymer of styrene, dimethylacrylamide, vinylbenzylimidazole and 1-vinylbenzyl-3-hydroxyethylimidazolium chloride (40:30:10:20 molar ratio)

Polymer E. Copolymer of styrene, 4-vinylpyridine and N-(2-hydroxyethyl)-4-vinylpyridinium chloride (30:38:32 molar ratio)

Polymer F. Copolymer of styrene, (vinylbenzyl) dimethyloctylammonium chloride), isobutoxymethyl acrylamide and divinylbenzene (40:20:34:6 molar ratio)

In a preferred embodiment of the invention, the encapsulated organic particles comprise up to about 50 wt. % of the image-receiving layer.

The amount of water insoluble, cationic, polymeric particles used should be high enough so that the images printed on the recording element will have a sufficiently high density, but low enough so that the interconnected pore structure formed by the aggregates is not filled. In a preferred embodiment of the invention, the water-insoluble, cationic, polymeric particles are present in an amount of from about 5 to about 30 weight % of the image-receiving layer.

The image-receiving layer employed in the invention may also contain a polymeric binder in an amount insufficient to alter its porosity. In a preferred embodiment, the polymeric binder is a hydrophilic polymer, such as poly(vinyl alcohol), poly(vinyl pyrrolidone), gelatin, cellulose ethers, poly (oxazolines), poly(vinylacetamides), partially hydrolyzed poly(vinyl acetate/vinyl alcohol), poly(acrylic acid), poly (acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like; or a low Tg latex such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc. The polymeric binder should be chosen so that it is compatible with the aforementioned particles.

The amount of binder used should be sufficient to impart cohesive strength to the ink jet recording element, but should also be minimized so that the interconnected pore structure formed by the aggregates is not filled in by the binder. In a preferred embodiment of the invention, the weight ratio of the binder to the total amount of particles is from about 1:20 to about 1:5.

In addition to the image-receiving layer, the recording element may also contain a base layer, next to the support, the function of which is to absorb the solvent from the ink. Materials useful for this layer include inorganic particles and polymeric binder.

In addition to the image-receiving layer, the recording element may also contain a layer on top of the image-receiving layer, the function of which is to provide gloss. Materials useful for this layer include sub-micron inorganic particles and/or polymeric binder.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, Ektacolor paper made by Eastman Kodak Co. is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the image-receiving layer to the support, the surface of the support may be subjected to a corona-discharge treatment prior to applying the image-receiving layer. The adhesion of the image-receiving layer to the support may also be improved by coating a subbing layer on the support. Examples of materials useful in a subbing layer include halogenated phenols and partially hydrolyzed vinyl chloride-co-vinylacetate polymer.

The coating composition can be coated either from water or organic solvents, however water is preferred. The total solids content should be selected to yield a useful coating thickness in the most economical way, and for particulate coating formulations, solids contents from 10–40 wt. % are typical.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

The coating composition may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 $\mu$m, preferably from about 5 to about 40 $\mu$m.

After coating, the ink jet recording element may be subject to calendering or supercalendering to enhance surface smoothness. In a preferred embodiment of the invention, the ink jet recording element is subject to hot soft-nip calendering at a temperature of about 65° C. and a pressure of 14000 kg/m at a speed of from about 0.15 m/s to about 0.3 m/s.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples are provided to illustrate the invention.

EXAMPLES

Synthesis of Encapsulated Particle 1 Employed in the Invention 200 g of deionized water and 2 g of cetyltrimethylammonium bromide (CTAB) were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of 2,2'-azobis(2-methylpropionamidine) hydrochloride (AMA) was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 100 g of n-butyl methacrylate, 100 g of ethyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 40 wt. % solids and the particle size was 68 nm.

Synthesis of Encapsulated Particle 2 Employed in the Invention 200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 200 g of ethyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 41 wt. % solids and the particle size was 72 nm.

Synthesis of Encapsulated Particle 3 Employed in the Invention 200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 100 g of ethyl methacrylate, 100 g of methyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 39 wt. % solids and the particle size was 70 nm.

Element 1 of the Invention

A coating solution for a base layer was prepared by mixing 254 dry g of precipitated calcium carbonate Albagloss-s® (Specialty Minerals Inc.) as a 70% solution, 22 dry g of silica gel Gasil® 23F (Crosfield Ltd.), 2.6 dry g of poly(vinyl alcohol) Airvol® 125 (Air Products) as a 10% solution, 21 dry g of styrene-butadiene latex CP692NA® (Dow Chemical Co.) as a 50% solution and 0.8 g of Alcogum® L-229 (Alco Chemical Co.). The solids of the coating solution was adjusted to 35 wt. % by adding water. The base layer coating solution was bead-coated at 25° C. on Ektacolor Edge Paper (Eastman Kodak Co.) and dried by forced air at 60° C. The thickness of the base layer was 25 $\mu$m or 27 g/m$^2$.

A coating solution for the image receiving layer was prepared by mixing 15.0 dry g of alumina Dispal® 14N4-80 (Condea Vista) as a 20 wt. % solution, 2.4 dry g of fumed alumina Cab-O-Sperse® PG003 (Cabot Corp.) as a 40 wt. % solution, 0.6 dry g of poly(vinyl alcohol) Gohsenol® GH-17 (Nippon Gohsei Co. Ltd.) as a 10 wt. % solution, 1.2 dry g of Polymer A as a 20 wt. % solution, 1.2 dry g of Polymer B as a 20 wt. % solution, 0.9 dry g of Encapsulated Particles 1 as a 40 wt. % solution, 0.1 g of Silwet® L-7602 (Witco. Corp.), 0.2 g of Silwet® L-7230 (Witco. Corp.) and water to total 153 g.

The image-receiving layer coating solution was bead-coated at 25° C. on top of the base layer described above. The recording element was then dried by forced air at 60° C. for 80 seconds followed by 38° C. for 8 minutes. The thickness of the image-receiving layer was 8 $\mu$m or 8.6 g/m$^2$.

Element 2 of the Invention

This element was prepared the same as Element 1 except that 0.9 dry g of Encapsulated Particles 2 as a 41 wt. % solution was used instead of Encapsulated Particles 1.

Element 3 of the Invention

This element was prepared the same as Element 1 except that 0.9 dry g of Encapsulated Particles 3 as a 39 wt. % solution was used instead of Encapsulated Particles 1.

Synthesis of Comparative Encapsulated Particles 1 (Tg of Encapsulating Polymer is greater than 100° C.)

200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 200 g of methyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 40 wt. % solids and the particle size was 70 nm. The Tg of the encapsulating organic polymer is about 105° C.

Synthesis of Comparative Encapsulated Particles 2 (Tg of Encapsulating Polymer is greater than 100° C.)

200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 190 g of methyl methacrylate, 10 g of ethylene glycol dimethacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 40 wt. % solids and the particle size was 76 nm.

The Tg of the encapsulating organic polymer is about 110° C. The presence of a small amount of the ethyleneglycol dimethacrylate increases the Tg value of the homopolymer derived from methyl methacrylate by about 5° C.

Comparative Element 1

This element was prepared the same as Element 1 except that 0.9 dry g of Comparative Encapsulated Particles 1 as a 40 wt. % solution was used instead of Encapsulated Particles 1.

Comparative Element 2

This element was prepared the same as Element 1 except that 0.9 dry g of Comparative Encapsulated Particles 2 as a 40 wt. % solution was used instead of Encapsulated Particles 1.

Coating Quality

The above dried coatings for visually evaluated for cracking defects. Results are tabulated in Table 2 below.

Image Quality & Dry Time

An Epson Stylus Color 740 printer for dye-based inks using Color Ink Cartridge S0201911/IC3CL01 was used to print on the above recording elements. The image consisted of adjacent patches of cyan, magenta, yellow, black, green, red and blue patches, each patch being in the form of a rectangle 0.4 cm in width and 1.0 cm in length. Bleed between adjacent color patches was qualitatively assessed. A second image was printed, and immediately after ejection from the printer, the image was wiped with a soft cloth. The dry time was rated as 1 if no ink and was smudged on the image. The dry time was rated as 2 if some ink smudged, and 3 if a lot of ink smudged. Results are shown in Table 2 as follows:

TABLE 2

| Recording Element | Coating Quality | Image Quality | Dry Time |
|---|---|---|---|
| 1 | No cracking | Little bleeding | 1 |
| 2 | No cracking | Little bleeding | 1 |
| 3 | No cracking | Little bleeding | 1 |
| Comparative 1 | Cracking | Severe Bleeding | 2 |
| Comparative 2 | Cracking | Severe Bleeding | 2 |

The above table shows that the recording elements employed in the invention have good coating quality, image quality and instant dry time as compared to the comparative recording elements.

This invention has been described with particular reference to preferred embodiments thereof but it will be understood that modifications can be made within the spirit and scope of the invention.

What is claimed is:

1. An ink jet printing method comprising the steps of:

A) providing an ink jet printer that is responsive to digital data signals;

B) loading said printer with ink jet recording element comprising a substrate having thereon a porous image-receiving layer comprising a combination of the following two particles:

a) organic particles encapsulated with an organic polymer having a Tg of less than about 100° C.; and b) water-insoluble, cationic, polymeric particles;

C) loading said printer with an ink jet ink composition; and

D) printing on said image-receiving layer using said ink jet ink composition in response to said digital data signals.

2. The method of claim 1 wherein said organic particles are polymeric particles.

3. The method of claim 2 wherein said polymeric particles are derived from a styrene-containing monomer.

4. The method of claim 2 wherein said polymeric particles are derived from an acrylate-containing monomer.

5. The method of claim 1 wherein said organic particles have a particle size of from about 5 nm to about 1000 nm.

6. The method of claim 1 wherein said Tg is from about −50° C. to about 65° C.

7. The method of claim 1 wherein said organic polymer is derived from a cationic, anionic or nonionic monomer.

8. The method of claim 7 wherein said monomer contains a quaternary ammonium, pyridinium, imidazolium, sulfonate, carboxylate or phosphonate functionality.

9. The method of claim 1 wherein said organic polymer is derived from an acrylate-containing monomer or a styrene-containing monomer.

10. The method of claim 1 wherein said organic particles are encapsulated with said organic polymer by polymerizing a monomer in the presence of said organic particles.

11. The method of claim 1 wherein said organic particles are encapsulated with said organic polymer by adsorption of said organic polymer onto the surface of said organic particles.

12. The method of claim 1 wherein said organic particles are encapsulated with said organic polymer by chemical bond formation between said organic particles and said organic polymer.

13. The method of claim 1 wherein the weight ratio of said organic particles to said organic polymer is from about 0.2:1 to about 20:1.

14. The method of claim 1 wherein said water-insoluble, cationic, polymeric particles are in the form of a latex which contains a polymer having a quaternary ammonium salt moiety.

15. The method of claim 1 wherein said water-insoluble, cationic, polymeric particles have a mean particle size of from about 10 to about 500 nm.

16. The method of claim 1 wherein said encapsulated particles are present in an amount up to about 50 weight % of said image-receiving layer and said water-insoluble, cationic, polymeric particles are present in an amount of from about 5 to about 30 weight % of said image-receiving layer.

17. The method of claim 1 wherein said image-receiving layer also contains additional particles having a mean particle size of up to about 5 $\mu$m.

18. The method of claim 17 wherein said additional particles are inorganic particles.

19. The method of claim 1 wherein said image-receiving layer also contains a binder.

20. The method of claim 1 wherein a base layer is present between said substrate and said image-receiving layer.

* * * * *